United States Patent [19]

Jensen

[11] 4,204,647

[45] May 27, 1980

[54] MINCING MACHINE

[76] Inventor: Stig K. Jensen, Norreas 65, 4200 Slagelse, Denmark

[21] Appl. No.: 916,405

[22] Filed: Jun. 16, 1978

[30] Foreign Application Priority Data

Jun. 17, 1977 [DK] Denmark ..... 268577/77

[51] Int. Cl.[2] ..... B02C 18/30

[52] U.S. Cl. ..... 241/82.6; 241/285 A

[58] Field of Search ..... 99/516; 425/202, 203, 425/207, 215; 241/82.1-82.7, 245, 247, 285 R, 285 A

[56] References Cited

U.S. PATENT DOCUMENTS 3,847,360 11/1974 Seydelmann ..... 241/82.5

*Primary Examiner*—Mark Rosenbaum

*Attorney, Agent, or Firm*—A. C. Nolte, Jr.; Edward B. Hunter

[57] ABSTRACT

A mincing machine, especially a meat mincing machine, of the type which has a rotatable knife disc 1 in front of a disc 2 with holes, and means for feeding mincing material including bone fragments to the knife disc and pressing out minced material minus the bone fragments through the disc having apertures, said knife disc and disc with apertures being arranged in a housing, characterized in that the housing in the region adjacent the knife disc has at least one recess constructed and arranged to receive and relinquish said bone fragments contained in the meat.

4 Claims, 3 Drawing Figures

MINCING MACHINE

Figure 1:
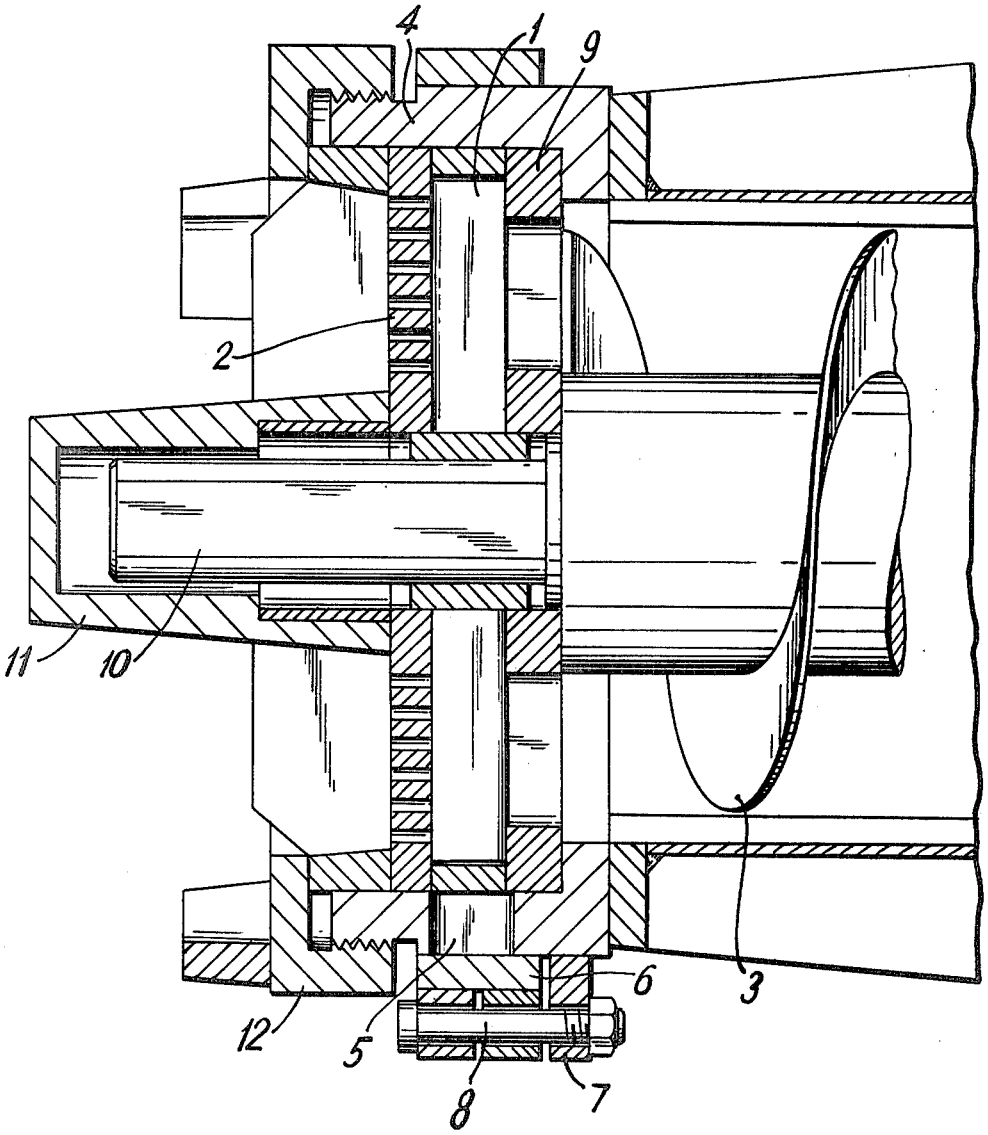

The invention relates to a mincing machine, especially a meat mincing machine, of the type having a rotatable knife disc in front of a disc having apertures, and means for feeding mincing material to the knife disc and for pressing the material through the disc having apertures, said knife disc and disc with apertures being arranged in a surrounding housing.

Such machines are used to a great extent for making minced meat for the canned goods industry. The increasing mechanization of the boning of meat in slaughterhouses has caused that bones rather often are found in the mincing material. In hitherto known mincing machines of the type stated these bones were minced together with the meat and remained therein during the further preparing thereof. This can cause inconveniences. For instance, a large manufacturer of hamburgers in one year paid more than a million dollars as compensation for teeth, claimed to have been broken when eating hamburgers. A close examination of the hamburgers from this manufacturer indicated that 85% thereof contained fragments of bone.

It is the object of the invention to provide a mincing machine of the type stated which is able to make minced meat with a considerable smaller content of bone fragments than the previously known mincing machines, and according to the invention this is obtained thereby that the enclosing housing in the region around the knife disc has one or more recesses. It has turned out that bone fragments in the mincing material will have a tendency to gather in these hollows, displacing the meat that has filled out the hollows when starting the working of the machine. By using this machine for manufacturing minced meat for hamburgers it was possible to obtain a reducement of hamburger containing bone fragments from 85% to 15%.

According to the invention the recesses may be formed as through-holes in the surrounding housing and externally be closed by means of a detachable covering ring. In this way bone fragments can easily be removed by detaching the covering ring without taking apart the machine.

Below the invention will be explained further referring to the drawing in which

Figure 2:
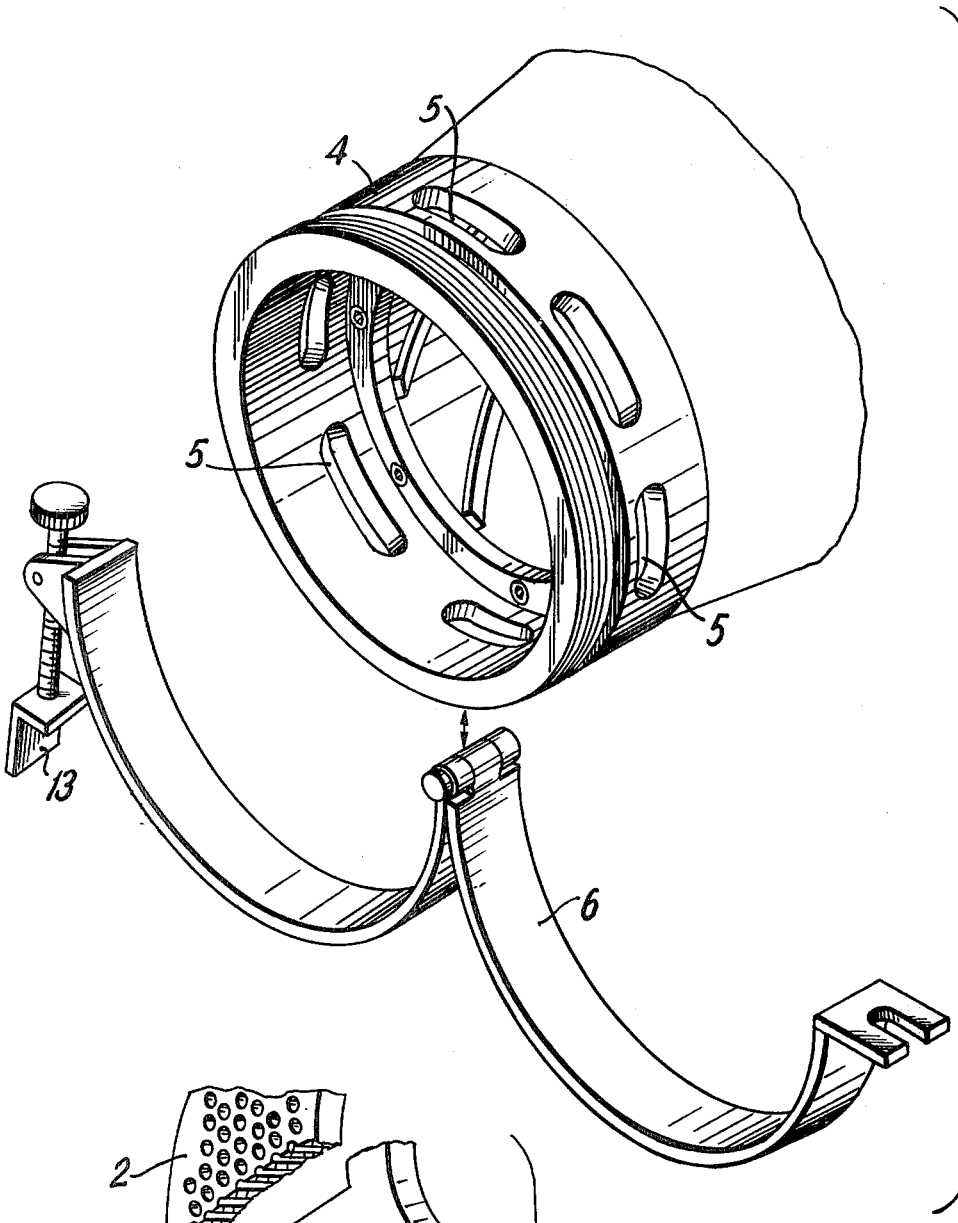
Figure 3:
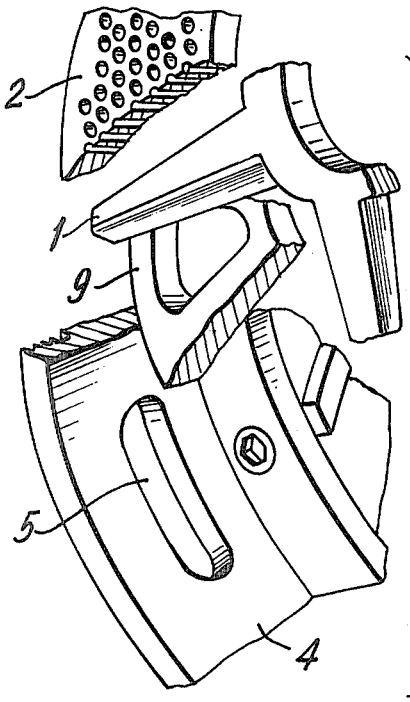

FIG. 1 shows a longitudinal section through the front portion of a mincing machine according to the invention, FIG. 2 a perspective showing of a housing for the machine showed in FIG. 1, with a cover ring detached, and FIG. 3 a perspective schematic showing of the essential parts of the machine.

The mincing machine shown in the drawing has a housing 4 in which is arranged a screw member 3, being by its foremost stud 10 rotatably supported in a bearing member 11 arranged in a bearing cover 12 that is screwed on the foremost part of the housing 4. Between the bearing cover 12 and an internal shoulder in the housing 4 are fixedly arranged, a front apertured disc and a rear apertured disc 9. The apertured discs 2 and 9 are spaced apart and disposed between them and contacting them is a knife disc 1.

As seen in FIG. 2, the cylindrical housing 4 is provided about its periphery with a series of co-acting and aligned recesses extending thereabout. As the knife 1 rotates, the end portions of its blades communicate with and pass under the spaced recesses 5 and simultaneously deposit some of the mincing material within said recesses 5. The remainder is pushed out from the holes in the outer disc member 2. To temporarily retain the material thus deposited in the recesses 5, a bifurcated band-like closure or keeper 6 is provided (see FIG. 2) which may be releasably secured as by the bolt means 8 to the projection 7 on the underside of the housing component 4.

When using the machine material to be minced is carried from a trough or hopper, by the screw member 3, to the front end of the housing 4 where it is pressed through the relatively large holes in the rear apertured disc 9 and where, by the relative movement between the knife disc 1 and the apertured disc 9, a first cutting of the material takes place. From the knife area the mincing material is carried further on through small holes in the front knife disc whereby a fine disintegration of the mincing material is made before it is removed from the machine.

As discussed supra with the conventionally used mechanical bone removing equipment it is impossible to prevent the appearance of bone fragments in the meat delivered to the mincing or grinding apparatus. In hitherto known mincing machines these bone fragments have been disintegrated together with the meat and pressed out through the fine holes in the front apertured disc 2 together with the minced meat.

However, in the machine shown in the drawing, the bone fragments have a tendency to be carried outwards and be collected in the holes 5, displacing the meat which initially fills those holes. Therefore, when using the machine at least some of the bone fragments in the meat will be collected in the holes 5 from which they may be removed from time to time by opening a buckle 13 on the cover ring 6 and swinging down the two half-parts thereof around the bolt 8.

I claim:

1. A meat grinding machine comprising a cylindrical housing defining a path for meat to be ground, means for advancing the meat along said path, an apertured plate extending across the path and a rotary cutting element disposed in said path adjacent to and upstream of said plate, said housing, in the region of said cutting element having recess means communicating with said path which constitutes a series of aligned co-acting recesses spaced from each other and extending around the periphery of said housing to enable the displacement of meat particles deposited in said recesses with bone fragments included in said meat.

2. A machine as claimed in claim 1 wherein access means are associated with said recess means, said access means permitting removal of bone fragments from said recess means.

3. A machine as claimed in claim 2 wherein said recess means comprise through-holes formed in said housing, said access means comprising detachable band means disposed at the exterior of the housing and effective selectively to open and close said recess means to permit removal of bone fragments therefrom.

4. A machine as claimed in claim 3 wherein said housing, in the region of said recess means, has a circular section and said band means comprises a pair of semicircular elements, a pair of adjacent ends of which are pivoted to each other and to said housing opposite ends of said band elements being releasably secured to one another.

* * * * *